United States Patent [19]

Buhler

[11] Patent Number: 4,724,653

[45] Date of Patent: Feb. 16, 1988

[54] PROCESS FOR REPAIRING OR LAYING A RAILROAD TRACK

[75] Inventor: Fritz Buhler, Ecublens, Switzerland

[73] Assignee: Les Fils d'Auguste Scheuchzer S.A., Lausanne, Switzerland

[21] Appl. No.: 876,844

[22] Filed: Jun. 20, 1986

[30] Foreign Application Priority Data

Jul. 2, 1985 [EP] European Pat. Off. ..... 85201055.2

[51] Int. Cl.[4] ..... E01B 35/06

[52] U.S. Cl. ..... 33/228; 33/287; 104/7.2

[58] Field of Search ..... 33/287, 228, 227; 107/107.2, 108; 73/146

[56] References Cited

U.S. PATENT DOCUMENTS

| | | | |
|---|---|---|---|
| 3,690,262 | 9/1972 | Plasser et al. | 104/7.2 |
| 3,821,932 | 7/1974 | Theurer et al. | 104/7.2 |
| 4,166,291 | 8/1979 | Shupe | 104/7.2 X |
| 4,173,073 | 11/1979 | Fukazawa et al. | 104/7.2 X |
| 4,356,771 | 11/1982 | Theurer | 104/7.2 |
| 4,535,699 | 8/1985 | Buhler | 33/287 |

*Primary Examiner*—William D. Martin, Jr.

*Attorney, Agent, or Firm*—Robert E. Burns; Emmanuel J. Lobato

[57] ABSTRACT

A levelling and shifting machine and a transmitter system (1) are used, the latter being installed on a carriage parked on the track and transmitting a spreading beam in the horizontal plane for levelling and a spreading beam in the vertical plane (Fr) for shifting, these beams defining an absolute measuring base. The receivers for levelling and shifting, which are installed on a measuring carriage of the machine, are designed for self-centering relative to the line of incidence of one of the said beams or the other during each measurement. In a curve of the track (3), the vertical beam (Fr) defines a cord of this curve, and the set position of the receiver defines the current value of the pitch of the curve ($fm_0$, $fm_1$ etc). A computer calculates the desired value of the pitch ($f_0$, $f_1$ etc.) and the variation ($y_0$, $Y_1$ etc.) between the two values, the latter variation determining the shifting correction.

The measuring interval (G') covered by the machine without a change in the position of the transmitter (1) is selected greater than the length (G) of the cord, and the initial measuring point ($A_0$) is selected on the secant passing through the cord beyond the point of intersection of the beam (Fr) and the track (3), so that the sum of the maximum pitches towards one side and the other is compatible with the travel of the receiver on its measuring carriage.

6 Claims, 14 Drawing Figures

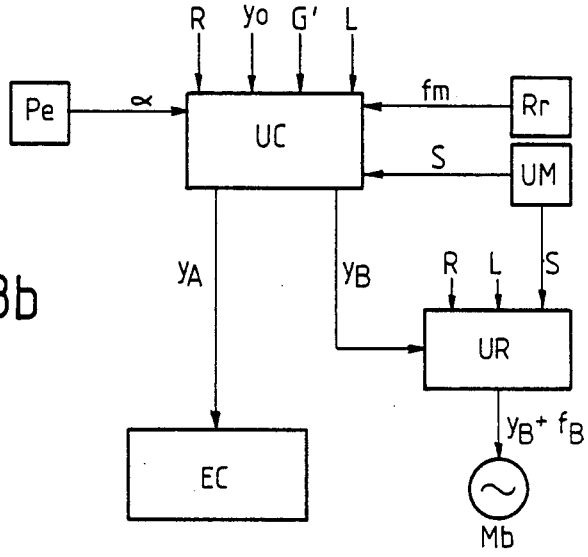
Fig. 8b
Fig. 9
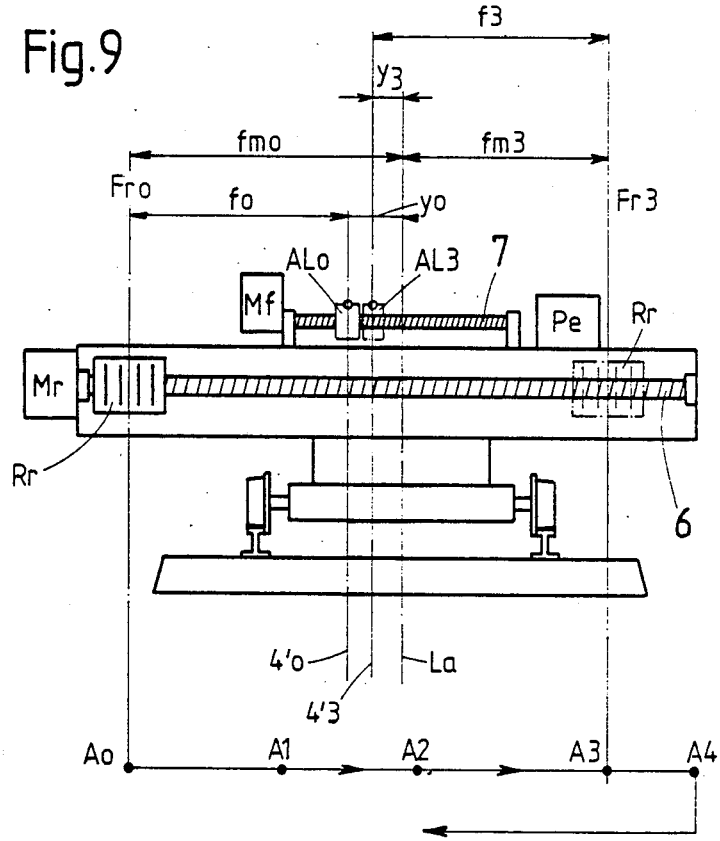

PROCESS FOR REPAIRING OR LAYING A RAILROAD TRACK

FIELD OF THE INVENTION

The invention relates to a process according to the pre-characterizing clause of claim 1.

PRIOR ART

A machine in the form of a tamper/leveller/shifter, by means of which this process can be carried out, is known from U.S. Pat. No. 4,535,619 of the applicant. The transmitter which consists of a laser transmitter is designed so that its beam can be rotated on its axis in order to transmit a spreading or sweeping beam in a vertical plane, serving as a reference base for shifting, and a horizontal beam serving as a reference base for levelling. The two receivers are automatically coordinated with the vertical beam and the horizontal beam respectively. This machine advances in steps from tie to tie, and at each stop levelling is carried out and then, after the laser transmitter has been rotated through 90°, shifting is carried out. It is also possible to carry out levelling every two ties, whilst shifting is effected at each intermediate tie.

In the curves, it is known to use the chord of a track section as an absolute reference line, in the known machine this chord being formed by a laser beam spreading or sweeping in a vertical plane. This chord extends between the transmitter located on the guide rail or axis of the track and the point of intersection of the beam with the guide rail or track axis. To carry out the shifting correction, the pitch of this chord is measured and compared with the known pitch of the desired curve, and the difference is calculated and taken as a measure of the lateral displacement of the rails in one direction or the other.

Up to now, the measuring interval over which the transmitter remains fixed, whilst the machine approaches it step by step, has been identical to the chord, that is to say the initial measurement in a measuring interval starts at the point of intersection of the beam with the guide rail or axis of the track. This measuring interval corresponding to the chord is limited in length because of the condition that the greatest pitch must not exceed the possibility of a lateral displacement of the receiver on the machine, since this receiver must be coordinated with the point of incidence of the beam, the amount of lateral displacement possible outside the frame of the machine usually being limited by the need to avoid penetrating into the gage of the parallel track so as not to impede traffic on this track.

In view of these conditions, in the curves, it is necessary to select relatively short measuring intervals and consequently move the laser transmitter frequently to define the following measuring interval, thereby causing loss of time, increasing the number of manipulations and reducing the efficiency of the shifting operations.

SUMMARY OF THE INVENTION

The present invention provides a process which makes it possible to widen the measuring interval and therefore the interval which the machine can cross in steps, without the location of the transmitter being changed.

To achieve this, the process according to the invention is defined by the characteristics of claim 1.

Preferred embodiments are described in claims 2 and 3.

On the known machines, the receivers for shifting and levelling are installed on a front measuring carriage which defines the front point of a relative measuring base formed by a reference line; the position of this reference line serves, by means of the adjustment data of these receivers, to determine the correction values for the track which is displaced directly under the reference line, at the working point located behind the said front point. Under these conditions, the machine operator only knows the correction values at the moment of displacement of the track, and it may happen that an obstacle prevents any displacement or prescribes a particular displacement of the track.

One device for controlling a track-repairing machine which avoids this disadvantage is defined, according to the invention, by the characteristics of claim 4.

A preferred arrangement of the receivers is described in claim 5.

BRIEF DESCRIPTION OF THE DRAWINGS

The invention is explained in more detail below by means of the drawings which illustrate diagrammatically an embodiment of the device and preferred details of the device.

FIGS. 8, 8*a* and 8*b* show block diagrams of the device for three different methods of controlling the track corrections.

FIG. 9 shows diagrammatically a cross-section through the track in the region of the receiver for shifting, illustrating the pitch-calculating system, and underneath, the distance covered by this receiver on its support during the measurements at the various measuring points.

DESCRIPTION OF THE EMBODIMENTS

Figures 1, 2, 3, 4:
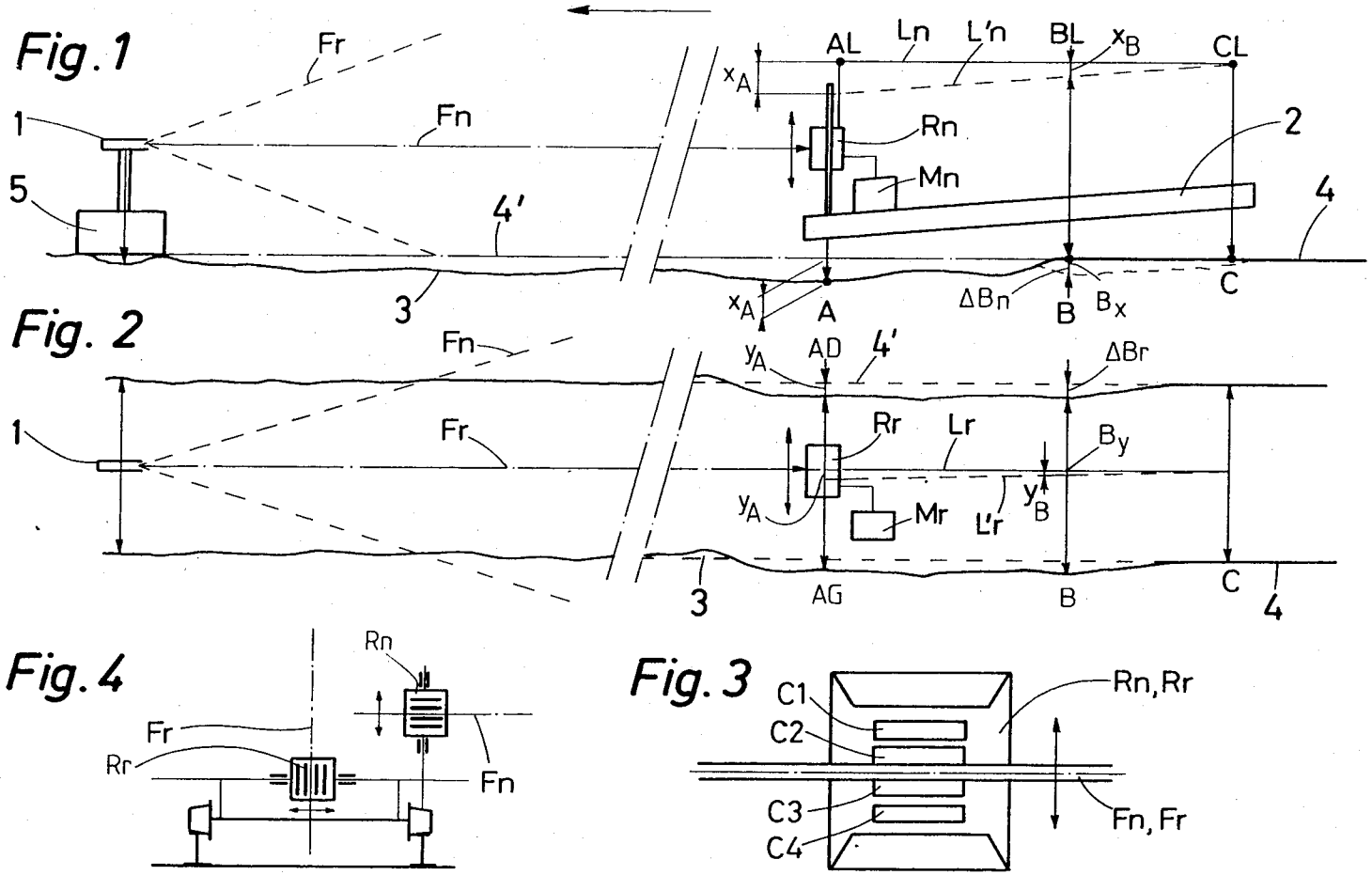
FIG. 1 shows diagrammatically, in a side view, the laser transmitter with the receiver for levelling, a dot-and-dash line representing the horizontal beam and broken lines representing the vertical beam.
FIG. 2 shows the same view as FIG. 1, but in a horizontal projection, with the receiver for shifting, the vertical beam being represented by a dot-and-dash line whilst the horizontal beam is represented by broken lines.
FIG. 3 shows diagrammatically the laser receiver either for shifting or for levelling, the laser beam being adjusted.
FIG. 4 shows diagrammatically a transverse view of the track with the levelling and shifting receivers.

The operating principle of a machine making it possible to carry out the process according to the invention will first be described by means of FIGS. 1 to 5 in terms of its use on straight rail sections, in order to explain the shifting and levelling processes. Moreover, such a machine is described in U.S. Pat. No. 4,535,699. According to this principle, therefore, there is a single laser transmitter 1 located in front of a machine for levelling and shifting a railroad track, which advances according to the arrow (FIG. 1) and which is indicated diagrammatically in the drawings by a main frame 2. This transmitter 1 is designed to transmit a spreading or sweeping beam directed either horizontally for levelling (beam Fn) or, after rotation through 90°, vertically for shifting (beam Fr), a levelling receiver Rn and a shifting receiver Rr both being mounted on the machine, that is to say on a front measuring carriage (not shown) of the machine.

In FIG. 1 which shows a side view of the levelling control device, the line 3 represents the old track which is to be corrected, the defects in this track obviously having been greatly exaggerated to make it easier to understand the figure, a broken line represents the portion of this old track which has just been corrected, the line 4 represents the new corrected track, and the dot-and-dash line 4' represents the desired track defined by the axis of the laser which, at the start of work, is set parallel to this desired track.

The device comprises a laser transmitter 1 which transmits a horizontal beam Fn and which is mounted on a carriage 5 parked in a stationary manner at a selected location on the old track 3 in front of the machine which, in the particular case under consideraton, is a tamper/leveller/shifter symbolised by the frame 2 and hereinafter designated simply by the term "machine". This machine is equipped with a known relative measuring base formed by the points A, B, C on the track, which are defined in a known way, for example by means of sensors belonging to measuring carriages running on the independent tracks of the bogies of the machine and suspended below the main frame 2 of the latter. The point C defined by the rear measuring carriage is located on the track 4 already corrected. The point A, the position of which has been exaggerated in FIG. 1, is located on the track not yet corrected, this being the reason why the frame 2 is inclined forwards. The point B represents the working point which is therefore located near the working elements which serve to position the track and which consist in a known way of shifting and levelling pinch-bars. In FIG. 1, the point B has just been corrected, just as the point C is also corrected.

Level with the point A and mounted on the front measuring carriage is a laser receiver for levelling Rn which can be adjusted in the vertical direction relative to the carriage frame by means of an adjusting motor Mn. A reference line Ln serves as a relative measuring base for levelling. In the example under consideration, an element carrying the front end AL of this reference line Ln is fastened to the receiver Rn. This end AL is located above the point A. In the present case, this reference line Ln is assumed to be embodied by a wire stretched on the measuring carriages. This wire is fastened to the point CL arranged level with the point C and, by virtue of its position, controls in a well-known way, via a control device, the position of the levelling pinch-bars at the point BL located level with the point B.

The laser receiver for levelling Rn, like the laser receiver for shifting Rr which will be described later, consists of four photoelectric cells C1 to C4 shown in FIG. 3 and is designed in such a way that it can be moved into the desired position by means of the adjusting motor Mn as a function of the line of incidence of the horizontal laser beam Fn on the cells, the setting being obtained as soon as the beam is located exactly between the two central cells C2 and C3.

As illustrated in FIG. 1, the adjustment has already been made, so that the reference line Ln, which before correction, occupied the position represented by the line L'n, now has the correct position parallel to the axis of the laser. This means that the point AL has moved vertically upwards by the distance $x_A$ corresponding to the height by which the track is to be raised at the point A, and that the point BL has been corrected vertically by the distance $x_B$, thus defining, at the working point, the point Bx which is located exactly on the theoretical line 4' and at which the track 3 has been raised by the pinch-bars by the levelling correction distance ΔBn. BC therefore represents the portion of corrected track, whilst AB represents the uncorrected portion.

Of course, this reference line Ln could be formed by any other means, whether mechanical or not, for example a light ray, and the measuring carriages defining the points A and C are not necessarily located underneath the frame 2, but can be on small auxiliary carriages which would run at a fixed distance to the front and to the rear of the frame 2 respectively.

FIG. 2 shows in a similar way to FIG. 1 a plan view of the shifting control device working with a vertical laser beam Fr. The shifting receiver Rr which, like the receiver Rn, is installed on the front measuring carriage is adjustable relative to this carriage on a transverse guide as a function of the vertical beam Fr by means of a motor Mr. A reference line Lr serves as a relative measuring base for shifting and is connected to the receiver Rr in the example under consideration and for shifting work carried out on straight tracks. In FIG. 2, an unbroken line indicates the position of the reference line Lr already corrected, and a broken line represents the reference line L'r in the uncorrected state. In this view, the position A of the reference point comprises the two points AG on the left-hand rail and AD on the right-hand rail. Level with these points AG, AD, the reference line Lr has shifted transversely by the distance $y_A$, and level with the point B it has shifted by the distance $y_B$, thus defining the desired position By of the axis of the track which is displaced by the shifting correction distance ΔBr by the controlled pinch-bars.

The pinch-bars for correcting the track in the horizontal and vertical planes at the point B of the machine are actuated by positioning motors for levelling and shifting, controlled as a function of the respective distances $x_B$ and $y_B$ which are determined by the relative measuring bases, as indicated in FIGS. 1 and 2.

According to an alternative embodiment the reference lines Ln and Lr forming the relative measuring base can also be arranged on the measuring carriages in a fixed manner and therefore independently of the receivers Rn and Rr, for example level with the longitudinal central axis of the front measuring carriage (point A) and of the rear measuring carriage (point C) or level with the guide rail. In this case, the distances $x_B$ and $y_B$ respectively determining the track corrections are defined, on the basis of the distances $x_A$ and $y_A$, by the ratios $x_A/x_B$ and $y_A/y_B$ which are only dependent on the known distances $\overline{AC}$ and $\overline{AB}$. These distances $x_A$ and $y_A$ are given by the position of the receivers Rn and Rr on the relative measuring base at the point A.

FIG. 4 shows diagrammatically a cross-section of the track and front measuring carriage in the region of the levelling receiver Rn and shifting receiver Rr, showing their relative position, and in this particular case it has been assumed that the shifting receiver Rr is located on the central axis of the track, whilst the levelling receiver Rn is located on the guide rail which is usually the lowest track in a curve.

Figure 5:
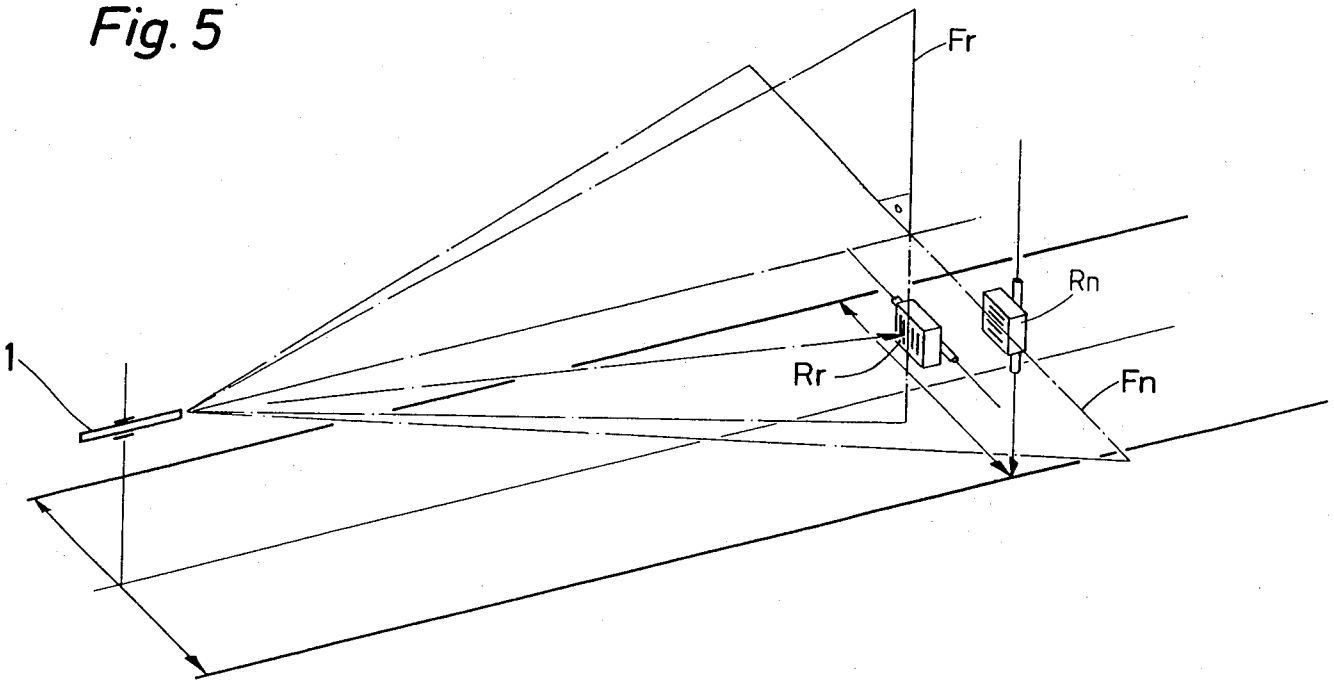
FIG. 5 is a diagrammatic perspective view illustrating the principle of the device with the two beams and the two receivers.

FIG. 5 illustrates the two systems simultaneously in perspective and shows the horizontal beam Fn and vertical beam Fr as well as the vertically movable levelling receiver Rn and horizontally movable shifting receiver Rr. The laser transmitter 1 is located in the axis of the track.

Figure 6:
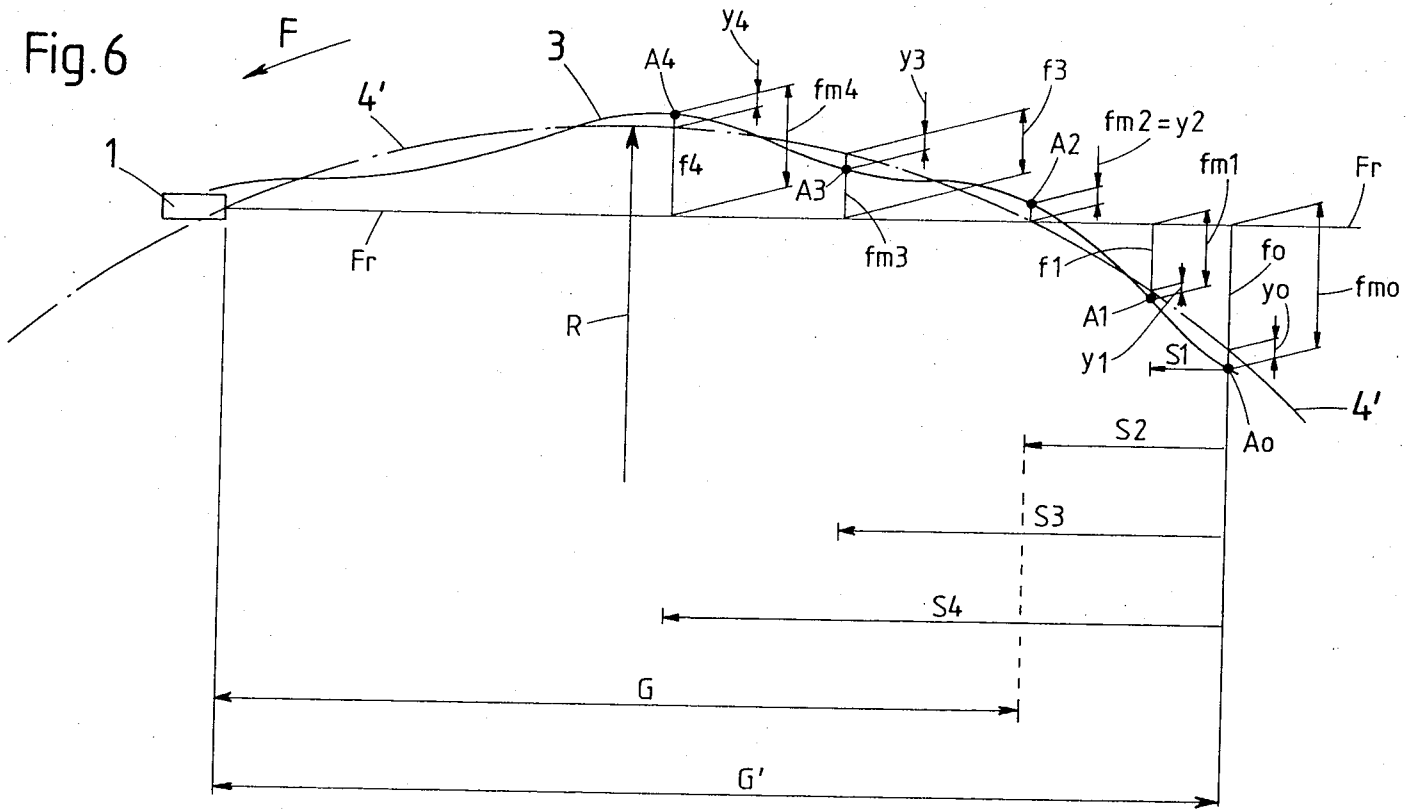
FIG. 6 shows diagrammatically a plan view over a curved section of the track, where the variation in relation to the theoretical curve indicated by a dot-and-dash line has been exaggerated for easier understanding and in which several measuring points have been shown in order to illustrate the shifting operation.

FIG. 6 shows the shifting system in a curved section of the track 3 before correction, and in it, a dot-and-dash line represents the known theoretical curve 4' having the radius R and defining the position in which the track 3 should be corrected. For the sake of simplification, FIG. 6 only shows the guide rail of the track or the central axis of the track and only indicates the point A of the relative measuring base A, B, C (FIG. 2), designating the points $A_0$, $A_1$, $A_2$, $A_3$, $A_4$ at the various measuring points where the machine stops. The distances between the track 3 and the theoretical curve 4' are, of course, greatly exaggerated in FIG. 6. The transmitter 1 located on the track in front of the machine transmits a vertical beam Fr which cuts across the curve of the track and thus forms a secant.

Hitherto, according to the conventional process, to carry out shifting work in a curve the cord has been selected as a measuring interval, during which the machine advances in steps towards the transmitter, without the need to change the position of the latter, and the initial measurement has been made at the intersection of the beam with the guide rail or track axis, thus there have only been the chord pitches located on the same side of the rail. Of course, the maximum chord was limited by the condition that the maximum pitch should not exceed the possible travel of the receiver on the machine.

According to the invention, as illustrated in FIG. 6, a greater measuring interval G' is selected, and this extends beyond the chord past the point of intersection of the beam with the guide rail or track axis, up to the point $A_0$ which, in the selected example, represents the location of initial measurement and correction. FIG. 6 indicates the desired values of the pitches $f_0$, $f_1$, . . . $f_4$ (the distance between the theoretical curve 4' and the beam Fr) which are calculated by a computer UC (FIG. 8), the current values of the pitches $fm_0$, $fm_1$ . . . $fm_4$ (the distance between the guide rail or axis of the present track and Fr) which are measured, and the distances $y_0$, $y_1$, . . . $y_4$ defined by the differences $fm_0-fm=y_0$, $fm_1-f_1=y_1$, etc.

The maximum measuring interval G' must, of course, be selected in such a way that the sum of the maximum pitches on the left and on the right, which are the pitches $fm_0+fm_4$ in the example under consideration, is compatible with the travel of the receiver Rr which always matches up with the beam Fr.

In practice, on a track portion which does not have too many curves, the carriage 5 carrying the laser transmitter 1 can be positioned at the outset at a distance of approximately 350 to 400 meters from the machine, that is to say a greater distance than hitherto, and once the latter has advanced too near to the transmitter during the work, the carriage 5 is moved again by a distance of approximately 350 to 400 meters from the machine.

At the start of work, therefore, in the measuring interval G', the machine, together with the shifting receiver Rr, is located at the point $A_0$. More specifically, it is the front measuring carriage which is located at the point $A_0$. In this initial position, either the current value of the pitch $fm_0$ and therefore the distance $fm_0-f_0=y_0$ are known from the last measurement in the preceding measuring interval and can serve to adjust the laser beam Fr, or, if the repair work is starting, the distance $y_0$ is measured directly as the difference between the present position of the track and its desired position defined, for example, by a fixed marker or peg.

During the work, the machine follows the curve of the track 3 and arrives successively at the points $A_1$, $A_2$, $A_3$, $A_4$, etc., after covering a distance S1, S2, S3, S4, etc., whilst the shifting receiver Rr follows the vertical beam Fr of the laser and consequently continues to move automatically on its carriage up to the point of incidence with the beam Fr. This position of the receiver each time determines the current value of the pitch $fm_1$, $fm_2$, etc.

As the machine advances, at each measuring point $A_1$, $A_2$, etc., the desired value of the pitch $f_1$, $f_2$, etc., corresponding to the theoretical curve 4' is calculated. For this purpose, a pitch computer UC and a unit measuring the distance covered UM are used, as also explained in relation to FIG. 8. The computer UC calculates the desired value of the pitch in a known way for the curves and all the connecting curves as a function of the geometrical data, such as the radius R of the curve, the length G' of the selected measuring interval, the data for the variable radius of a connecting curve which include the length L of this curve, etc., and the distance covered S, and compares it with the measured pitch, that is to say the current value of this pitch. The corresponding distances $y_1$, $y_2$, etc., are calculated on the basis of the discrepancy between the two values.

Of course, if the discrepancy $fm-f$ gives a positive distance y, the rails are displaced in the direction of the beam Fr, as where the points $A_0$, $A_1$, $A_2$, $A_4$ are concerned, if the distance y is negative, the rails are displaced in the other direction, as where point $A_3$ is concerned.

At the point $A_2$, in the example illustrated in FIG. 6, the desired value of the pitch $f_2$ is zero, since the receiver is located exactly at the point of intersection between the theoretical curve 4' and the beam Fr. The current value of the pitch $fm_2$ is equal to the distance $y_2$.

Figure 7:
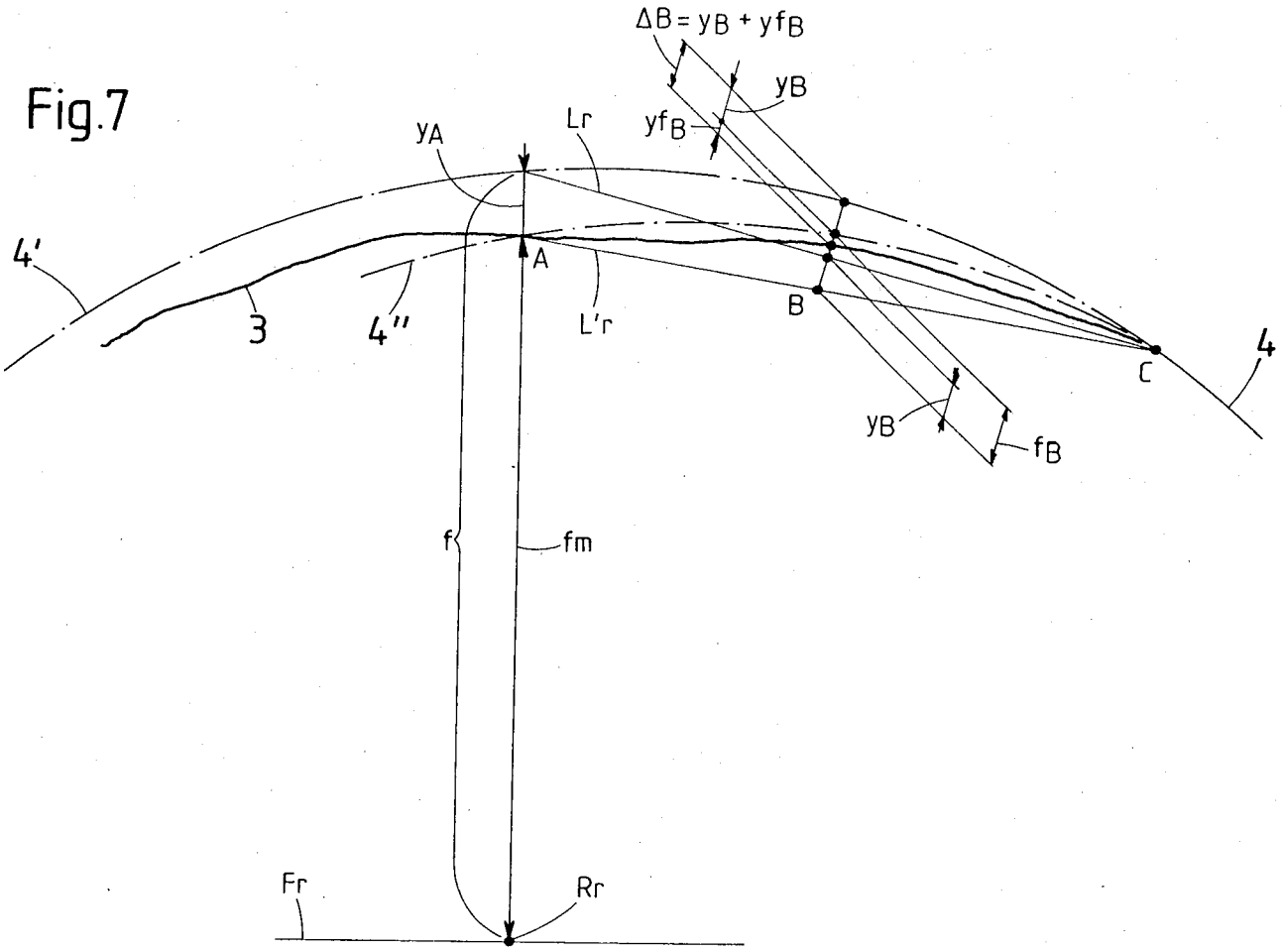
FIG. 7 shows an enlarged partial view of the curved section of the track according to FIG. 6, at a working point.

To carry out shifting work in a curve, the pitch $f_B$ of the relative measuring base must also be taken into account, as illustrated diagrammatically in FIG. 7 for a particular working position of the machine. This figure indicates the relative measuring base represented by the point A (on the uncorrected track 3), the working point B and the point C (on the corrected track 4), the reference line L'r before correction and Lr after correction, the receiver Rr centered on the beam Fr, thus determining the current pitch fm of the absolute measuring base, and the difference $fm-f=-y_A$ (f is the desired value of the pitch). The pitch $f_B$ is the distance between the theoretical curve and the reference line forming a chord of this curve. FIG. 7 shows the theoretical curve 4"

relation to the relative measuring base, with the reference line L'r still uncorrected; the pitch $f_B$ shown therefore relates to this theoretical curve.

The value of this pitch $f_B$ is always known; it is constant in a curve of constant radius and variable in a connecting curve and is calculated by a computer UR (FIG. 8) as a function of the distance covered.

Figure 8:
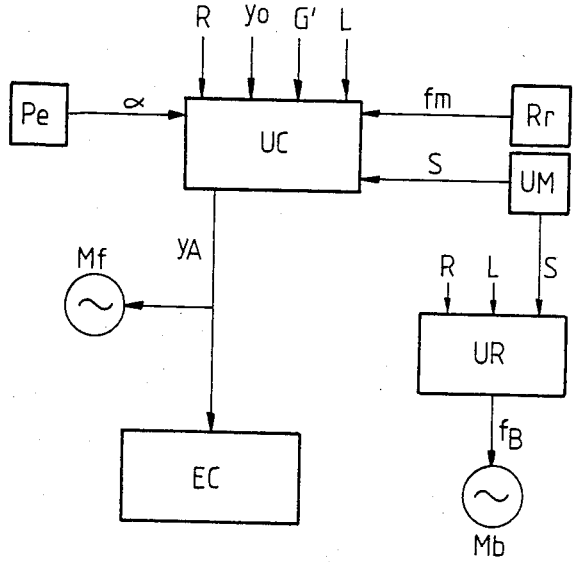

The procedure for correcting shifting is described in detail by means of FIG. 7 and FIG. 8 which shows a block diagram of the monitoring and control system in a curve.

The computer UC for calculating the pitches in the absolute measuring base is designed to calculate the desired values of the pitches f at each working point and to generate at its output a signal corresponding to the distance $y_A$ at the point A or $y_B$ at the point B. For this purpose, the following data are first entered before work starts, in a measuring interval G': the radius R of the curve of the track in question or the data for the variable radius of a connecting curve, the initial distance $y_0$ at the point $A_0$ measured in the track, for example in relation to a fixed marker or peg, and the length of the interval G'.

As the machine advances, the variable data are entered: the distance covered S measured by a measuring unit UM, the current value of the pitch fm measured by the receiver Rr, and the cant angle $\alpha$ measured in a known way by a pendulum Pe. In fact, tracks to be adjusted are always subject to cant defects, and consequently it is essential to correct the distances $y_A$ and $y_B$ as a function of the cant at the measuring points. This is carried out by means of a pendulum Pe installed on the relative measuring base.

To carry out correct shifting at the point B, there are two principal methods using a displaceable or stationary reference line Lr on the machine.

According to the first method, as illustrated in FIG. 7, there is a reference line Lr transversely adjustable independently of the position of the receiver Rr by means of a motor Mf (FIGS. 8 and 9). In this case, there appears at the output of the computer UC the distance $y_A$ at the point A corresponding to the distance $fm-f_0$ corrected, if appropriate, by a corrective dependent on the angle $\alpha$. This distance $y_A$ controls the motor Mf which moves the reference line Lr at the point A of this distance $y_A$. This corresponds to a difference $y_B$ at the working point B, where a stop or a reference element is displaced together with the reference line Lr, defining the intended position or desired position of the pinch-bars which correct the rails.

Furthermore, the computer UR calculates the pitch $f_B$ of the relative measuring base on the basis of the data S, R and L respectively and the other data for the variable radius of a connecting curve. The computer UR transmits an output signal corresponding to this pitch $f_B$, which controls a second motor Mb (FIG. 8). This motor corrects the position of the abovementioned stop in relation to the reference line Lr by an amount equal to $f_B$, so that the stop is now located exactly on the theoretical curve 4'.

The pinch-bars engaging the rails are now displaced by the shifting correction distance $\Delta B$ by means of a hydraulic drive which is actuated until the track is in the desired position defined by the stop, that is to say on the theoretical line 4'. As shown in FIG. 7, the value $\Delta B$ is equal to the sum of the distances $y_B$ and $yf_B$, $yf_B$ representing the distance between the current position of the uncorrected track 3 and the uncorrected reference line L'r.

According to the other shifting method (FIG. 8*a*), a stationary reference line Lr is used, the motor Mf is omitted and the computer UC calculates the distance $y_B$ at the point B and transmits an output signal corresponding to this distance $y_B$ to the motor Mb which also receives the signal corresponding to the pitch $f_B$ calculated by the computer UR. This motor Mb is therefore controlled by the two signals $y_B$ and $f_B$ and moves the stop over this distance $y_B$ and $f_B$ into the desired position.

As an alternative (FIG. 8*b*), the output signal $y_B$ from the computer UC can be entered into the computer UR which calculates the total displacement $y_B+f_B$ directly and transmits a corresponding signal to the motor Mb.

According to another alternative, it is also possible for the computer UC to transmit a signal corresponding to the distance $y_A$ to the computer UR which converts it into a signal corresponding to the distance $y_B$ at the point B. In this case, there is no need for the computer UC to transmit a signal $y_B$.

Alternatively, the computer UR sends a signal corresponding to $f_B$ to the computer UC which transmits a signal corresponding to the sum $y_B+f_B$ to the motor Mb as a control signal.

In all the cases described above, to carry out the shifting work, the hydraulic drive of the pinch-bars grasping the rails is controlled by a signal corresponding to the shifting correction $\Delta B=y_B+yf_B$ (FIG. 7), so that the rails are shifted into the desired position defined by the stop or the reference element in the relative measuring base. The hydraulic drive of the pinch-bars is therefore controlled indirectly by the computers UC and UR.

Alternatively, the following procedure may also be adopted: a position detector is provided, and this determines at each moment the current position of the pinch-bars and therefore of the track 3 and transmits a signal y relating to this to the computer UR. This computer UR not only calculates the pitch $f_B$, but also, on the basis of this pitch $f_B$ and in response to the signal representing the current position of the track 3, directly calculates the distance $yf_B$ (FIG. 7). In this case, the motor Mb is omitted, and the pinch-bars controlled directly by means of the output signal $y_B$ from the computer UC and the output signal $yf_B$ from the computer UR or on the basis of the signal corresponding to the sum $y_B+yf_B$ from the computer UR, without the need to use a displaceable stop or reference element determining the desired position. The block diagrams corresponding to this method of controlling the hydraulic drive of the pinch-bars would correspond to FIGS. 8, 8*a* and 8*b*, the only changes being that the motor Mb illustrated would represent the hydraulic drive of the pinch-bars and that the output signal corresponding to the pitch $f_B$ would have to be replaced by the signal corresponding to the distance $yf_B$.

Figure 8A:
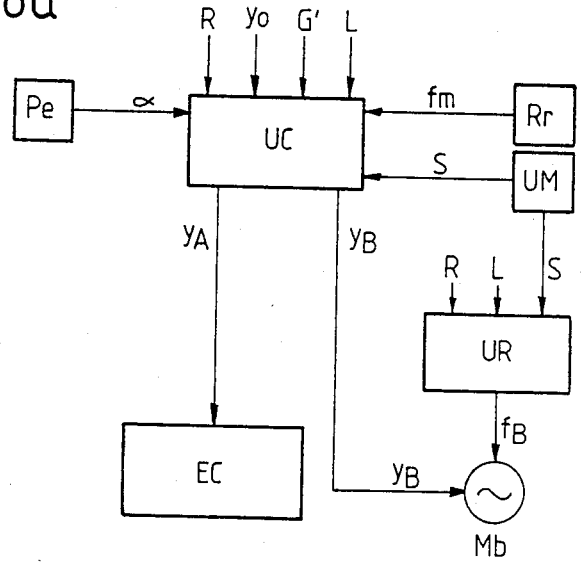

The unit EC illustrated in FIGS. 8, 8*a* and 8*b*, which receives the signal $y_A$, will be explained in the description of FIG. 9.

FIG. 9 shows a sectional view of the track and of the front measuring carriage, as seen from the front, at the point $A_0$ (FIG. 6) and, by a dot-and-dash line, at the point $A_3$, in each case before correction. At the starting point $A_0$ for shifting a track section, in the measuring interval G' the shifting receiver Rr is moved to the front end of the relative measuring base on the support 6 of the measuring carriage, at a distance from the central axis La of the measuring device (that is to say, the central longitudinal axis of the measuring carriages) equal to the value of the current pitch $fm_0$, for example by means of a screw driven by the motor Mr. The vertical beam Fr is centered relative to the receiver Rr. The front point $AL_0$ of the reference line is moved on the support 7 of the measuring carriage by means of the motor Mf by the distance $y_0$, that is to say the difference $fm_0-f_0$ at the center of the theoretical track $4'_0$.

At the measuring point $A_3$, the receiver Rr has moved along the support 6 by the distance of the measured pitch $fm_3$ which is smaller than the theoretical pitch $f_3$, making it possible to calculate the distance $y_3$. In this case, the front end $AL_3$ of the relative base is moved along on the support 7 of the measuring carriage to the center of the theoretical track $4'_3$.

FIG. 9 shows at the bottom the travel of the receiver Rr on its support 6 during the measurements at the points $A_0$ and $A_4$. In principle, the maximum width which the transverse support 6 can occupy is generally 3 meters.

Figure 10:
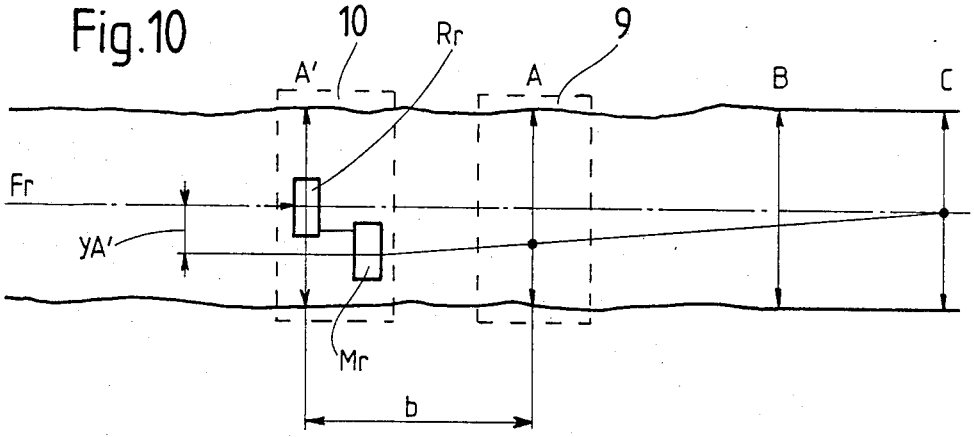
FIG. 10 shows diagrammatically a top view of a preferred embodiment of the device.

In the measuring systems described, the receivers Rr and Rn for shifting and levelling are arranged directly on the measuring carriage 9 (FIG. 10) which defines the point A of the relative measuring base, that is to say the correction values y are calculated and used directly to correct the track at the point B. The disadvantage of this system is that the machine operator only knows the correction values at the moment of displacement of the track, and it may happen that an obstacle prevents any displacement or prescribes a particular displacement of the track at the point B. To overcome this disadvantage, as illustrated in FIG. 10, the shifting and levelling receivers Rr and Rn are arranged on a special measuring carriage 10 at a distance b of 6 to 12 meters in front of the measuring carriage 9 defining the point A. This carriage 10 is, for example, connected to the front end of the machine by means of a coupling arm. In this case, the actual shifting value, that is to say the distance $y_A'$ measured at the point A' (and likewise the actual levelling value), is stored in the computer UC, until the measuring carriage 9 comes level with the measuring point A'. In the example, these stored shifting values (and levelling values) are displayed on a display means EC indicated in FIGS. 8, 8*a* and 8*b*, such as a screen, a recorder or any other means. This enables the machine operator to act 10 to 20 ties before the work is carried out, in order to make possible corrections. It is obvious that the levelling system will be designed in the same way.

As regards the arrangement of the receivers Rn and Rr which have hitherto always been installed independently of one another, it is necessary for the shifting receiver Rr always to be located outside the range of adjustment of the levelling receiver Rn, SO that one does not disturb the operation of the other. This receiver Rr is therefore installed either above or below the range of adjustment of the receiver Rn. The disadvantage of this known arrangement is that the effective working interval is reduced in relation to the measuring interval G', as defined in FIG. 6. In fact, when the machine approaches the transmitter, since the width of the beams decreases their coverage is concentrated in the middle, as a result of which the receiver Rr is soon located above or below the beam Fr, measurements can no longer be made and the machine would have to stop at a relatively long distance from the transmitter.

Figure 11:
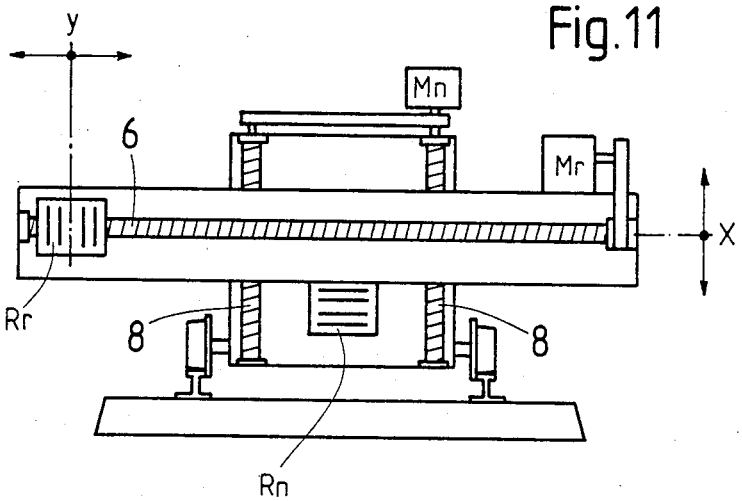
FIGS. 11 and 11*a* show diagrammatically a transverse view and a side view of a preferred arrangement of the two receivers.
Figure 11A:
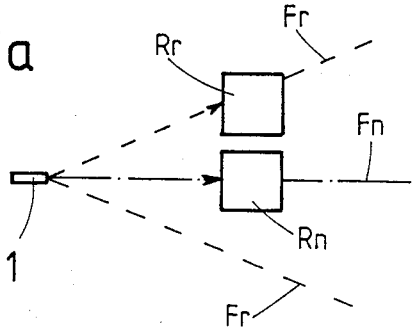

To avoid this disadvantage, an arrangement such as that illustrated in FIG. 11 is proposed. In this arrangement, it will be seen that the receiver Rn for the horizontal beam is mounted on the lower face of a transverse support 6, along which the receiver Rr for the vertical beam can move, for example on a screw driven by the motor Mr, to carry out the shifting measurement. The assembly consisting of this support 6 and of the receivers Rr and Rn is mounted, in turn, on a vertical support 8, along which the said assembly can move vertically, for example on screws driven by the motor Mn, so that the receiver Rn can carry out the levelling measurement. This makes it possible to utilize almost all the distance up to the transmitter, as illustrated in FIG. 11*a*, and thus increase the effective interval G'.

In fact, as a result of this construction, the receiver Rr, which can of course also be fastened to the upper face of the support 6, always moves vertically with the receiver Rn and is only at a short constant vertical distance from the latter.

Of course, the invention is not limited to the embodiments described, and many other alternative forms could be considered. Because the measuring interval G' can be selected wider than hitherto, the distances between the fixed markers or pegs installed along the track and defining the theoretical layout can also be greater, and consequently there are fewer of these markers.

I claim:

1. In a method of levelling, shifting and tamping a railroad track comprising:

providing a levelling, shifting and tamping machine, providing means for transmitting two planar laser beams, one in a vertical plane or shifting and the other in a horizontal plane for levelling and mounting said laser beam transmitting means on a carriage positioned a selected distance in front of said machine, said vertical beam defining a chord of a curved section of track, providing said machine with a measuring carriage and providing on said measuring carriage a first receiver for said vertical beam and a second receiver for said horizontal beam, said receivers being automatically selfcentering relative to said vertical beam and said horizontal beam respectively during measurement, providing on said machine computer means for calculating at each of a plurality of measuring points in a selected measuring interval the desired value of the pitch of the track in a curved section of track, and providing means controlled by said computer means for positioning the track, the improvement comprising extending said vertical beam defining a chord of a curved section of track to define a secant and correspondingly extending said horizontal beam, selecting a measuring interval of travel of machine without change of position of said laser beam transmitting means that is greater than the length of said chord, selecting an initial meausring point on said secant followed by successive measuring points on said secant and on said chord, said measuring interval of travel being selected so that the total of maximum pitches in opposite directions from said vertical beam is equal to travel of said second receiver on said measuring carriage.

2. A method of levelling, shifting and tamping a railroad track according to claim 1 in which said computer means comprises first and second computers, using said first computer for positioning the forward end of a reference line, the rear end of which is positioned by corrected track, and, using said second computer for calculating at each of plurality of working positions the desired pitch with reference to said reference line.

3. A method of levelling, shifting and tamping a railroad track according to claim 1 in which there is provided a reference line which is stationary relative to the machine, and in which said computer means comprises a first computer for calculating at each working station the distance between said vertical beam and said reference line and a second computer for calculating at each working station the desired pitch with reference to said reference line.

4. Apparatus for levelling, shifting and tamping a railroad track comprising, a leveling, shifting and tamping machine having a measuring carriage, means for transmitting two planar laser beams, one in a vertical plane for shifting and the other in a horizontal plane for levelling, said laser beam transmitting means being mounted on a movable carriage positioned from time to time at a selected distance in front of said machine, a first receiver for said vertical beam mounted on said measuring carriage for movement transversely thereof, said first receiver being self-centering with respect to said horizontal beam, a second receiver for said horizontal beam mounted on said measuring carriage for movement vertically thereof, said second receiver being self-centering with respect to said horizontal beam, said machine comprising means responsive to the positions of said receivers for positioning the track, and said measuring carriage being positioned a selected distance in front of said machine and being coupled with said machine.

5. Apparatus for levelling, shifting and tamping a railroad track comprising, a levelling, shifting and tamping machine having a measuring carriage, means for transmitting two planar laser beams, one in a vertical plane for shifting and the other in a horizontal plane for levelling, said laser beam transmitting means being mounted on a movable carriage positioned from time to time at a selected distance in front of said machine, a first receiver for said vertical beam and a second receiver for said horizontal beam and means for mounting said receivers on said measuring carriage, said mounting means comprising an elongate support extending transversely of said measuring carriage, means for mounting said first receiver for movement longitudinally of said support, menas controlled by said first receiver for movement of said first receiver along said support, said second receiver being mounted stationary on said support and means controlled by said second receiver for moving said support vertically, whereby said first receiver and said second receiver are self centering with respect to said vertical beam and said horizontal beam respectively, said machine comprising means responsive to the positions of said receivers for positioning the track.

6. Apparatus according to claim 5, in which said support is mounted on two vertical threaded shafts driven by a motor controlled by said second receiver and said first receiver is movable along said support by a horizontal threaded shaft driven by a motor controlled by said first receiver.

* * * * *